US008038583B2

(12) United States Patent
Bailar

(10) Patent No.: US 8,038,583 B2
(45) Date of Patent: Oct. 18, 2011

(54) SHOE ACCESSORY

(76) Inventor: Benjamin F. Bailar, Philadelphia, PA (US)

( * ) Notice: Subject to any disclaimer, the term of this patent is extended or adjusted under 35 U.S.C. 154(b) by 1882 days.

(21) Appl. No.: 11/019,886

(22) Filed: Dec. 22, 2004

(65) Prior Publication Data

US 2005/0137511 A1 Jun. 23, 2005

Related U.S. Application Data

(60) Provisional application No. 60/532,050, filed on Dec. 22, 2003.

(51) Int. Cl.
*A63B 21/00* (2006.01)

(52) U.S. Cl. ..... 482/79; 482/80; 482/105

(58) Field of Classification Search ..... 482/79, 482/80, 105; 36/7.6, 77 R, 30, 36, 102, 103, 36/132, 25 R, 43
See application file for complete search history.

(56) References Cited

U.S. PATENT DOCUMENTS

| | | | | | |
|---|---|---|---|---|---|
| 1,021,142 | A * | 3/1912 | Freeman | 36/7.8 |
| 1,386,028 | A * | 8/1921 | Roe | 36/7.6 |
| 1,487,390 | A * | 3/1924 | King | 36/7.6 |
| 1,954,569 | A * | 4/1934 | League | 36/7.6 |
| 2,484,389 | A * | 10/1949 | Schatz | 36/7.6 |
| 2,661,547 | A * | 12/1953 | Hyde et al. | 36/128 |
| 5,722,919 | A | 3/1998 | Timmer | 482/79 |
| 6,277,057 | B1 | 8/2001 | Hayden | 482/79 |
| 6,341,432 | B1 | 1/2002 | Muller | |
| 6,782,639 | B1 | 8/2004 | Muller | |
| 6,935,991 | B1 * | 8/2005 | Mangino | 482/51 |
| 2002/0026730 | A1 * | 3/2002 | Whatley | 36/132 |
| 2005/0055849 | A1 * | 3/2005 | Ha | 36/97 |

OTHER PUBLICATIONS

"What is EasyTone?", Reebok web page, retrieved from the Internet on Oct. 28, 2009 <URL:http://www.reebok.com/US/>.

"Skechers Shape-Ups Black Men's Shape-UPs Shoe," retrieved from the Internet on Oct. 28, 2009, pp. 1-3, <URL:http://www.shoes.com/Shopping/productdetails.aspx?catalog%5Fname=web&pg=5103085&p=E...>.

"MBT-Shoes.us", retrieved from the Internet on Dec. 2, 2009, <URL:http://www.mbt-shoes.us/>.

The Gym Ball Store. Rocker Boards for Balance Training and Core Stability Exercise, [online], [retrieved on Nov. 10, 2004]. Retrieved from the Internet <URL: http://gymball.com/rocker_boards.html>.

Welcome to TherapyZone. Rocker Board, [online], [retrieved on Nov. 10, 2004]. Retrieved from the Internet <URL: http://therapyzone.com/tz.asp?wci=catitem&addToCart=&ID=74000_03_00>.

* cited by examiner

*Primary Examiner* — Jerome W Donnelly
(74) *Attorney, Agent, or Firm* — Saul Ewing LLP

(57) ABSTRACT

The shoe accessory includes a platform for supporting a conventional shoe that is bendable in a manner corresponding to bending of a wearer's show during walking, etc. The shoe accessory's base has a convex or other non-planar surface that causes the shoe accessory to be stable in a longitudinal (heel-toe) direction, and unstable in a lateral (medial/lateral) direction. The non-planar surface may be defined by one or more ridge segments on the platform's bottom side. One or more straps are provided to temporarily secure the wearer's conventional shoe to the platform in a non-destructive manner. A generally U-shaped heel retainer may be provided adjacent a rear portion of the platform for receiving the heel of the shoe. The shoe accessory makes a flat-soled shoe laterally unstable while allowing for longitudinal stability and a naturalistic gait, and thus facilitates exercise of leg and foot muscles during normal walking, running, etc.

22 Claims, 8 Drawing Sheets

SHOE ACCESSORY

CROSS-REFERENCE TO RELATED APPLICATION

This application claims the benefit of U.S. Provisional Patent Application No. 60/532,050, filed Dec. 22, 2003, the entire disclosure of which is hereby incorporated herein by reference.

FIELD OF THE INVENTION

The present invention relates generally to the field of physical rehabilitation, and more particularly to a shoe accessory for facilitating rehabilitation of an injured ankle and/or the surrounding musculature of the leg and foot.

DISCUSSION OF RELATED ART

Various types of devices are promoted as aids in ankle injury rehabilitation. One type of device used for this purpose is a foot-supporting platform that is connected to a base via one or more supports. The supports allow movement of the platform while also providing resistance to its movement. One such device is shown in U.S. Pat. No. 6,277,057. Consequently, manipulation of the platform exercises the ankle, and associated foot/leg musculature, thereby aiding rehabilitation. However, such a device is rather elaborate, often costly and large in size. Alternatively, one or more weights are attached to the bottom of a platform to provide resistance instead of the supports. The platform is then attached to the foot using straps. One such device is shown in U.S. Pat. No. 5,722,919. This design at least partially addresses the drawbacks cited above. In both of these scenarios, however, the wearer retains proactive control of the movement of the ankle. Consequently, the wearer's neuromuscular system is not compelled to respond to unexpected movements of the ankle.

A more dynamic rehabilitation regime is achieved using wobble boards and rocker boards, which are unstable devices having a rigid (inflexible) flat upper platform on which a wearer stands, and a hemispherical or semicylindrical base, respectively. The wearer stands on the board while trying to prevent it from tipping over. The board's instability places unpredictable demands on the wearer's neuromuscular system thereby providing a more dynamic rehabilitation regime. Rocker boards are sometimes sold in pairs, one for each foot, to specifically target the ankles. However, a pair of wobble or rocker boards cannot accommodate naturalistic movement, particularly flexing of the foot as when walking, running, etc. As a result of this inability to accommodate naturalistic movement, the demands placed on the neuromuscular system, although more dynamic than the demands provided by a device fully under the wearer's control, are dissimilar to those experienced in the "real world", e.g. as when walking on uneven ground for example or abruptly changing direction of movement. Additionally, the limited mobility resulting from the use of a pair of wobble or rocker boards makes for an inconvenient rehabilitation regime.

Applicant has recognized that it is the rigidity/inflexibility of a rocker/wobble board's platform that prevents naturalistic movement. In other words, the platform's rigidity restricts the naturalistic movement of a foot/ankle in that it cannot conform to the natural flexing of a foot. Consequently, any attempt at a natural stride would require the wearer to balance on the front end of one rocker board and the back end of the other in the middle of each stride. Furthermore, because the line along which the foot naturally flexes is at an angle to the hinged mechanism of the knee, the ankle rotates during naturalistic movement. The rigidity of a pair of rocker boards would prevent this rotation, even if such a rocker board were carried by the foot.

A more naturalistic stride might be achieved with a pair of wobble boards. However, the point of balance with a pair of wobble boards is beneath the middle of the user's foot. This is considerably different than the point of balance during naturalistic movement, in which the point of balance shifts between the heel and ball of the foot. Furthermore, because of its hemispherical base a wobble board tends to rock back and forth and twist side to side. In addition, as with a pair of rocker boards, because the platform is rigid and cannot flex to accommodate the natural flexing of a foot, the ankle doesn't rotate as it would during naturalistic movement.

In addition, a wobble board would have to have a very tall base to be sufficiently high to accommodate a user's stride. Otherwise, a user will push off the front edge of the platform and land on the back edge. As consequences of a heightened platform, the point of balance moves further from the naturalistic point of balance, achievement of stability becomes more a matter of general neuromuscular control and conditioning rather than control and conditioning of the muscles around the ankle, and there is a greater the risk of the user overextending their neuromuscular system. A heightened platform could be widened in the lateral direction to reduce the angle of the board should it tip over in a side-to-side directly, thus helping prevent the user from overextending their neuromuscular system. However, this would mean a larger, heavier, and therefore more expensive item to manufacture, store, ship, etc. The increased weight and bulk would also hinder the users mobility with the device.

SUMMARY

The present invention provides a shoe-mountable shoe accessory including a platform that is free to bend in a manner corresponding to the flexing of the user's foot during walking, running, etc. and a base having a non-planar surface that causes the shoe accessory to be laterally unstable when the base rests on a substantially flat surface with the platform in a substantially horizontal orientation. In one embodiment, the platform is made of a flexible material that permits bending/flexing in an appropriate region corresponding to the ball of the foot. In another embodiment, the platform includes rigid sections connected by a hinge that permits bending/flexing in an appropriate region corresponding to the ball of the foot. The non-planar surface may have a variety of configurations that will provide the desired functionality. Preferably, the base is configured to cause the shoe accessory to be longitudinally stable relative to a flat or substantially flat surface while causing it to be laterally unstable.

The shoe accessory is configured for temporary attachment to a conventional shoe, e.g. using one or more straps with the sole of the shoe resting on the platform, in a non-destructive manner that will not damage the shoe. The platform may be provided with a generally U-shaped heel retainer that is positioned adjacent a rear portion of the platform for receiving a heel of a shoe. The shoe accessory will therefore be carried by and move/flex with the user's shoe, thereby accommodating naturalistic movement, as when the user is walking.

Accordingly, the present invention provides a nondestructive manner for making a flat-soled shoe laterally unstable, yet longitudinally stable, while accommodating a naturalistic stride. Consequently, demands on the nerves and muscles surrounding the ankles are similar to those found in the "real world" as when walking on uneven ground for example or abruptly changing direction, and the present invention provides for a more convenient rehabilitation regime. Consequently, the point of balance of the present invention is close to the naturalistic point of balance so that achievement of stability is primarily a matter of controlling and conditioning the muscles around the ankle. The present invention affords considerable mobility without resorting to a heightened platform, and reduces the risk of overextending the user's neuromuscular system without resorting to a larger platform. Thus, it can safely accommodate considerable mobility while also exploiting the advantages of being small in size, light in weight, and low in cost.

In addition, because of the elasticity of the strap(s) and the flexibility of the heel retainer used to attach the present invention to a shoe, the present invention can accommodate various shapes, sizes and designs of shoes. Because of this design, the shoe accessory is easy to put on and take off the user's shoes.

BRIEF DESCRIPTION OF THE DRAWINGS

The present invention will now be described by way of example with reference to the following drawings in which.

DETAILED DESCRIPTION

FIGS. 1-5 show an exemplary embodiment of a shoe accessory 10 in accordance with the present invention. The shoe accessory 10 includes a platform 12 having a substantially flat upper surface 14 for supporting a conventional shoe 50, such as a sneaker, in a stable manner relative to the platform 12/shoe accessory 10.

In the embodiment of FIGS. 1-5, the shoe accessory 10 includes a platform 12 that is a unitary body having heel and toe portions 12*a*, 12*b*. The platform 12, or at least a portion thereof, is formed of a semi-rigid material that is capable of flexing to act as a "hinge" in an appropriate location to enable the platform 12 to flex to accommodate the natural flexing of a foot during walking, running, etc. This flexing corresponds to the flexing of a shoe/foot, and is therefore located near the ball of the foot. More specifically this flexing of the foot (and shoe) occurs at a point in time between a probation stage, in which the foot's arch is flattened as the entire foot (shoe) rests on the ground, and a suspiration stage in which the foot's (shoe's) heel has left the ground and the foot's (shoe's) toe(s) remain on the ground. An approximate bend line is shown along line AA' of FIG. 2. For example, a molded rubber or other flexible material has been found suitable for this purpose. Virtually any material presently used for making soles of walking/running shoes may be used, as will be appreciated by those skilled in the art.

Figure 1:
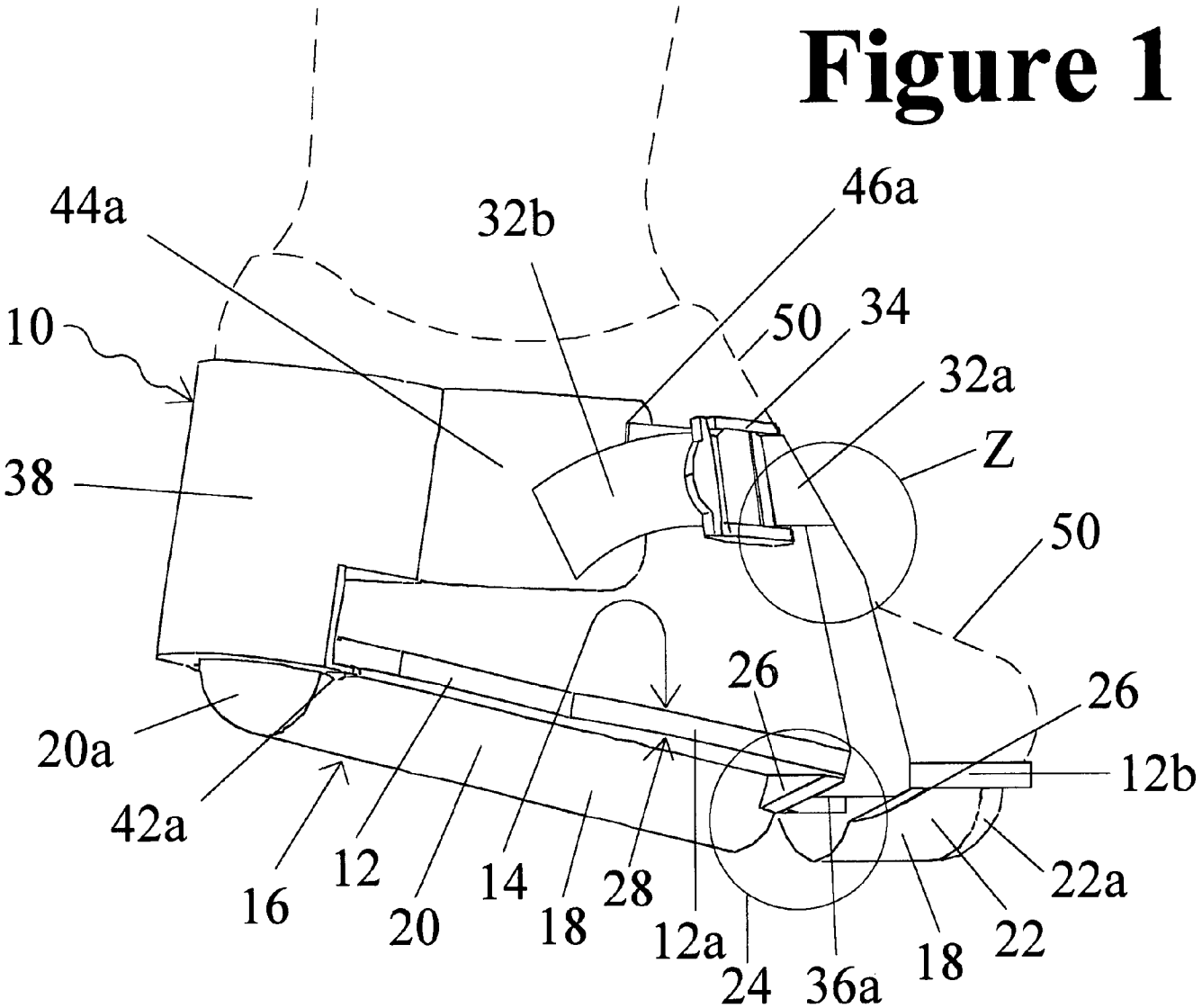
FIG. 1 is a rear perspective view of an exemplary shoe accessory in accordance with a first embodiment of the present invention.
Figure 2:
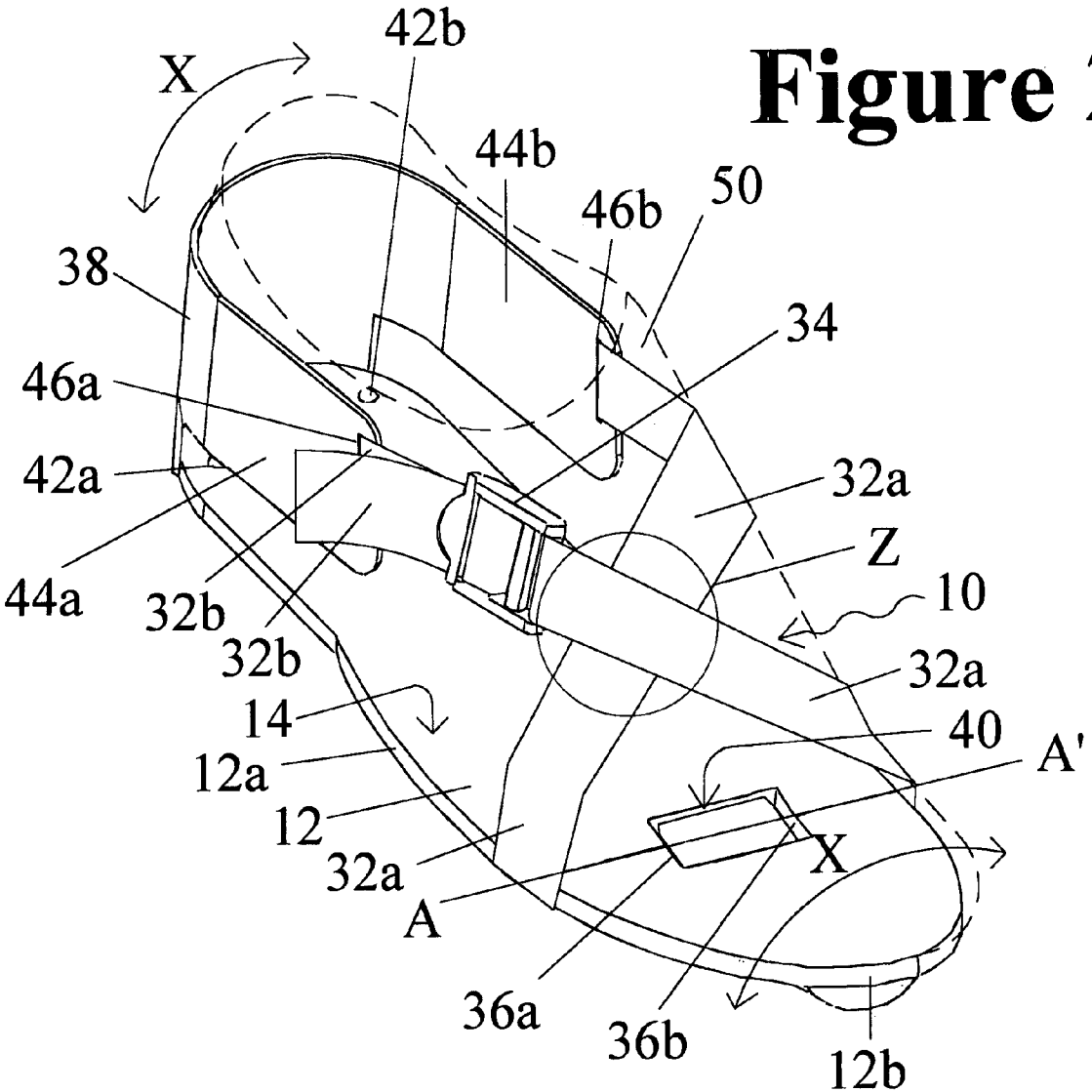
FIG. 2 is a front perspective view of the shoe accessory of FIG. 1.
Figure 3:
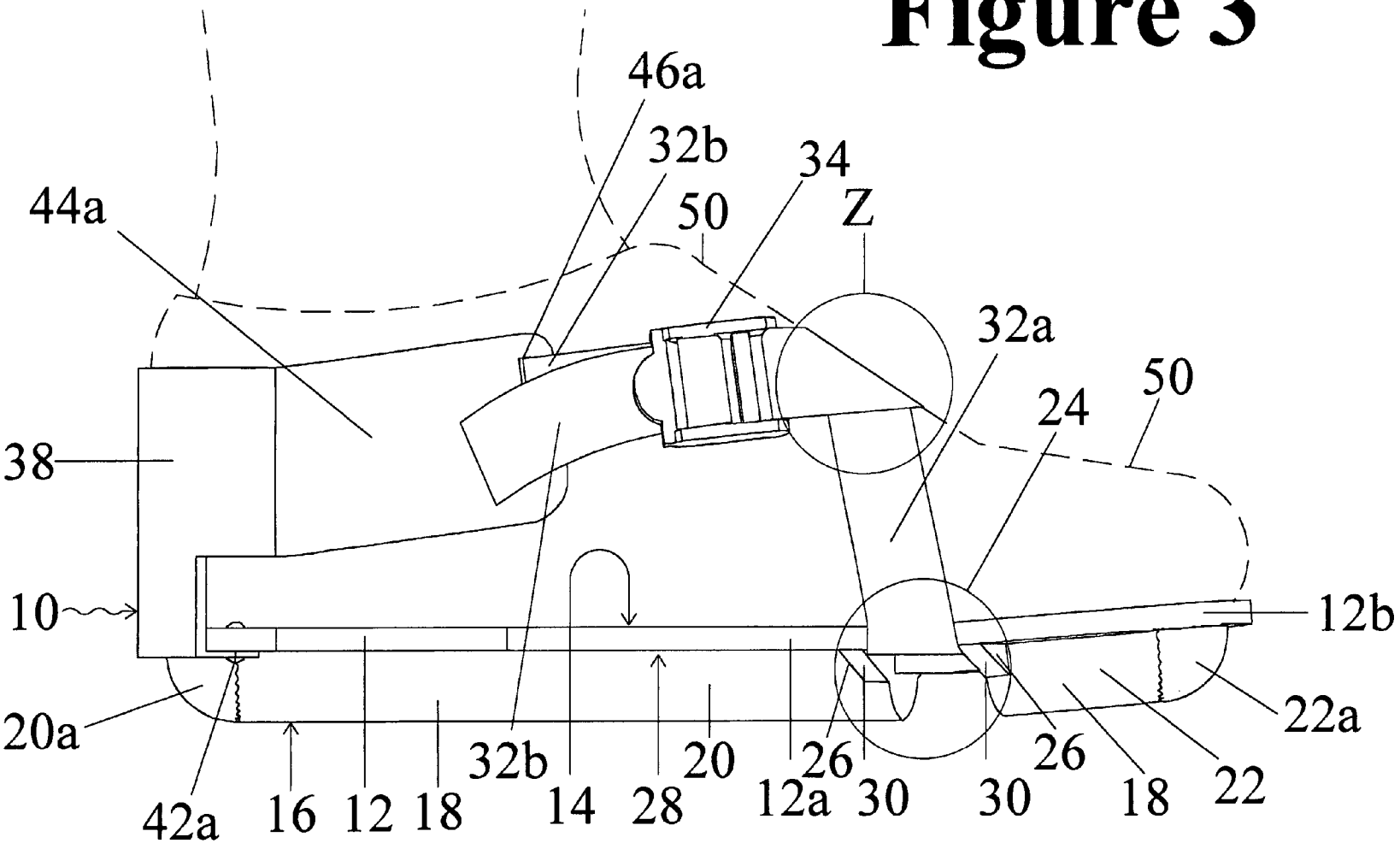
FIG. 3 is a side view of the shoe accessory of FIG. 1.
Figure 4:
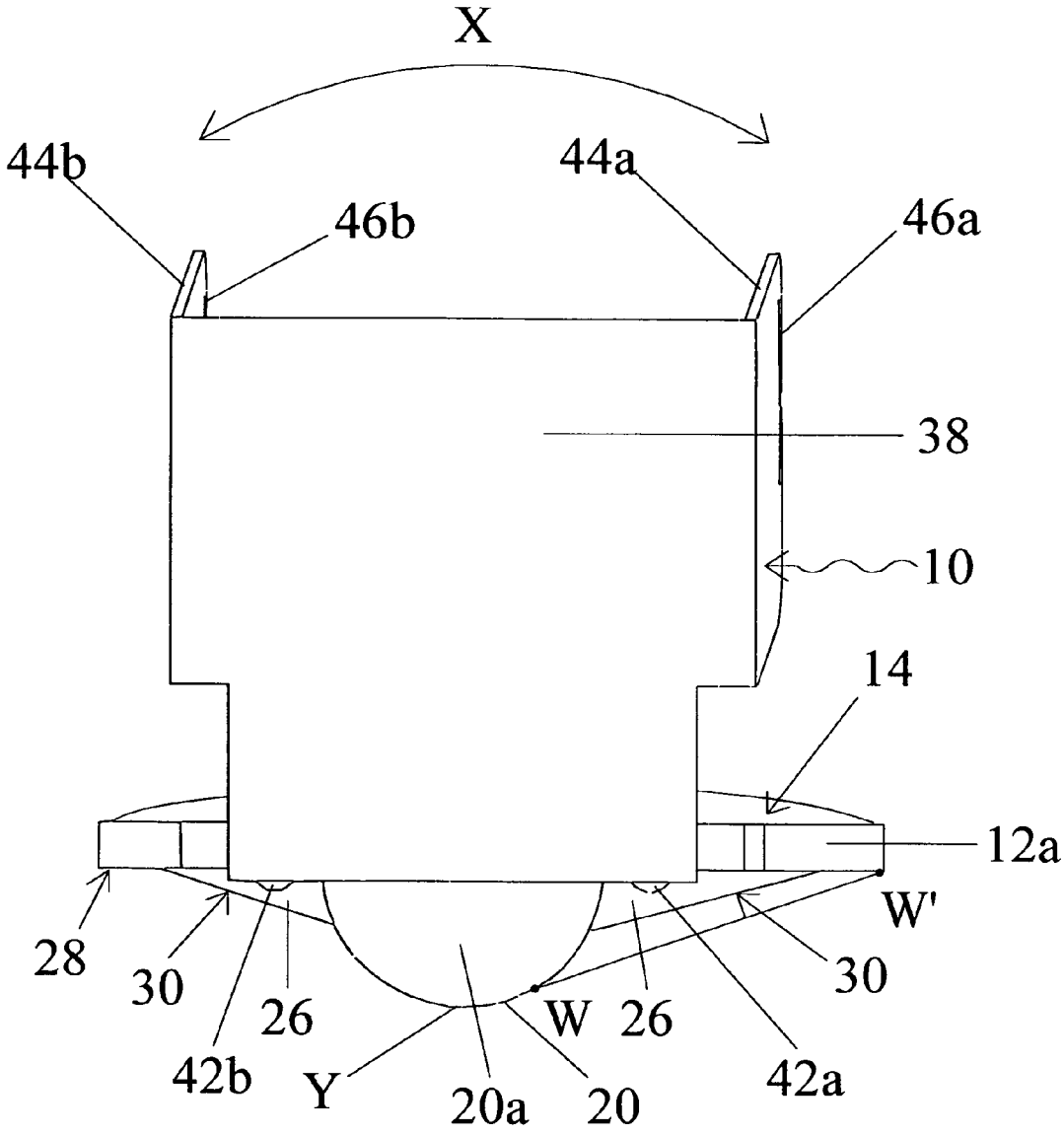
FIG. 4 is a rear view of the shoe accessory of FIG. 1.
Figure 5:
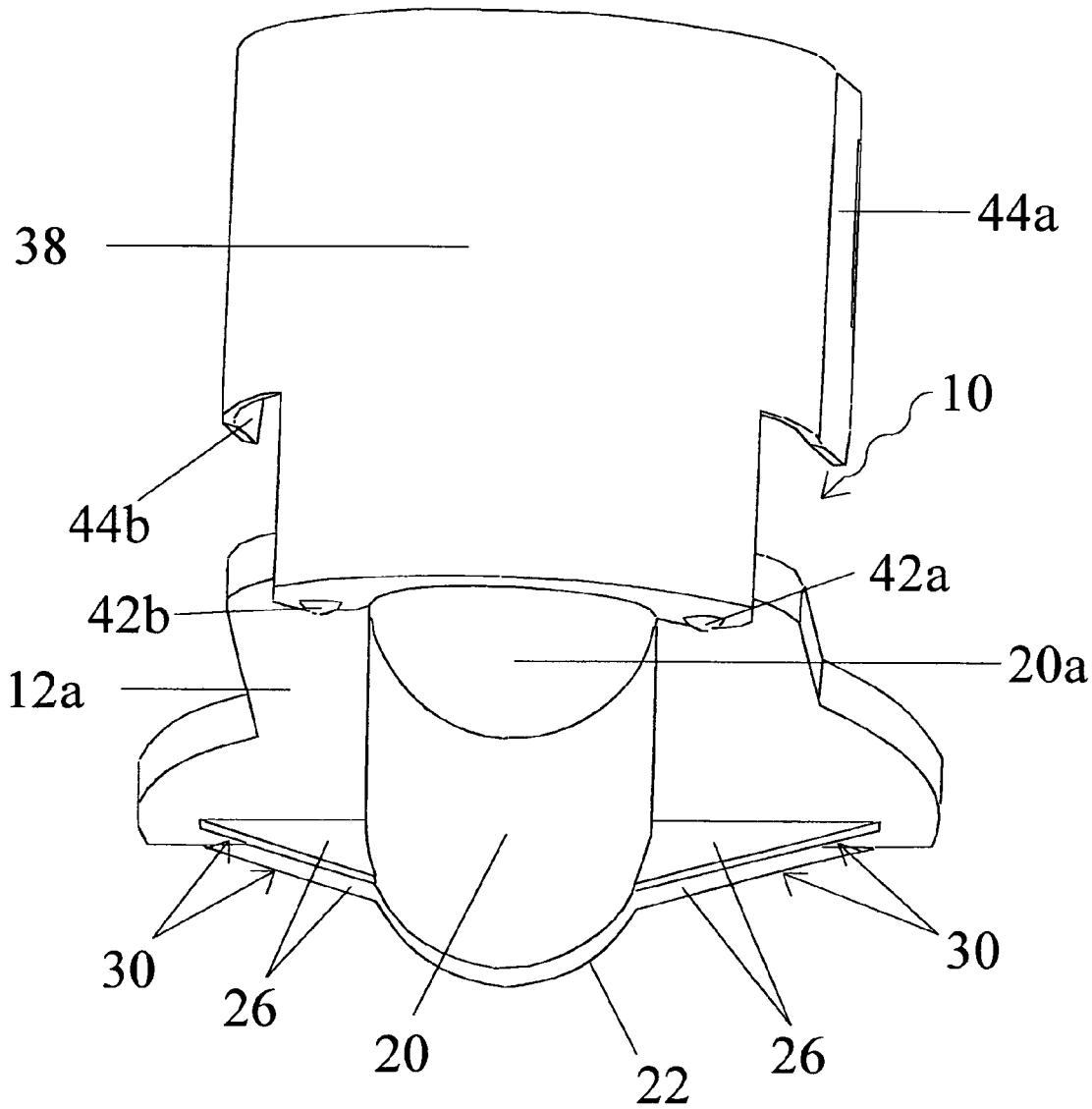
FIG. 5 is a rear view of the shoe accessory of FIG. 1, shown with the platform flexed in mid-step.

The shoe accessory 10 further includes a base 16 including a non-planar surface 18 that causes the shoe accessory 10 to be laterally (see X direction, FIGS. 2 and 4) unstable when the base rests on a substantially flat surface with the platform 12 in a substantially horizontal orientation, as best shown in FIGS. 3 and 4. This is due, at least in part, to the narrow region (see Y, FIG. 4) of the base 16 that will contact the ground during walking, running, etc. Preferably, the non-planar surface 18 is shaped to cause the shoe accessory 10 to be longitudinally stable when the base 16 rests on a substantially flat surface, as best shown in FIG. 3. As a non-limiting example, this may involve providing a non-planar surface 18 that is uniform in cross-section along a substantial portion, e.g. at least half, of its length in the heel-toe (longitudinal) direction. The non-planar surface 18 may have a variety of configurations that will provide the desired functionality. For example, the base 16 may include a ridge that is convex in shape. More specifically, the ridge may include a non-planar surface 18 that has a portion that is generally outwardly curved in the transverse (medial/lateral) direction, and that is elongated in the heel-toe (longitudinal) direction, as best shown in FIGS. 3, 4 and 5. An exemplary semicylindrical ridge is shown in FIGS. 1-5. Alternatively, the ridge may have a non-semicylindrical outward curvature in cross-section (see, e.g. FIG. 8), or may be generally chevron or wedge-shaped in cross-section (not shown).

Preferably the ridge includes a plurality of ridge segments, a first of which (ridge segment 20) extends from a back end of the platform (the heel portion) to just behind a bend line AA' about which the platform will flex under the wearer's body weight during walking, running, etc., and a second of which (ridge segment 22) extends from the front of the platform (the toe portion) to just in front of the bend line AA', as shown in FIG. 2. This leaves a ridge free span 24 to facilitate flexing of the platform in a manner corresponding to natural flexing of the foot, e.g. during walking, running, etc., as shown in FIG. 1, which shows the shoe accessory as flexed/bent during mid-step to accommodate the natural flexing of the foot during walking, running, etc. In one embodiment, the platform has a lesser resistance to flexing in the area of the ridge free span 24 to promote proper flexing of the platform. For example, this may be achieved by forming most of the platform from a relatively rigid material and using a less rigid material in the area of the ridge free span 24 region, or using a single material to form the entire platform 12 but also providing a reduced thickness portion of the platform at the ridge free span 24 region. Alternatively, the platform may have a greater resistance to flexing in the area of the ridge free span 24 region by providing a more rigid material in that area or by providing an increased thickness portion in that area.

In certain embodiments, the ends 20*a*, 22*a* of the ridge segments 20, 22 have longitudinally curved surfaces for engaging the ground in mid-step as the ridges begin to engage in mid-step, as best shown in FIG. 1. In the example of semicylindrical ridge segments 20, 22, the ends 20*a*, 22*a* may be quarter spherical, as shown in FIGS. 1-7, or simply longitudinally curved, as in FIG. 8. This enables the ridge segments 20, 22 to "roll" forward (or backward) as they engage the ground or begin to leave the ground, thus leading to a smoother stride.

Figure 8:
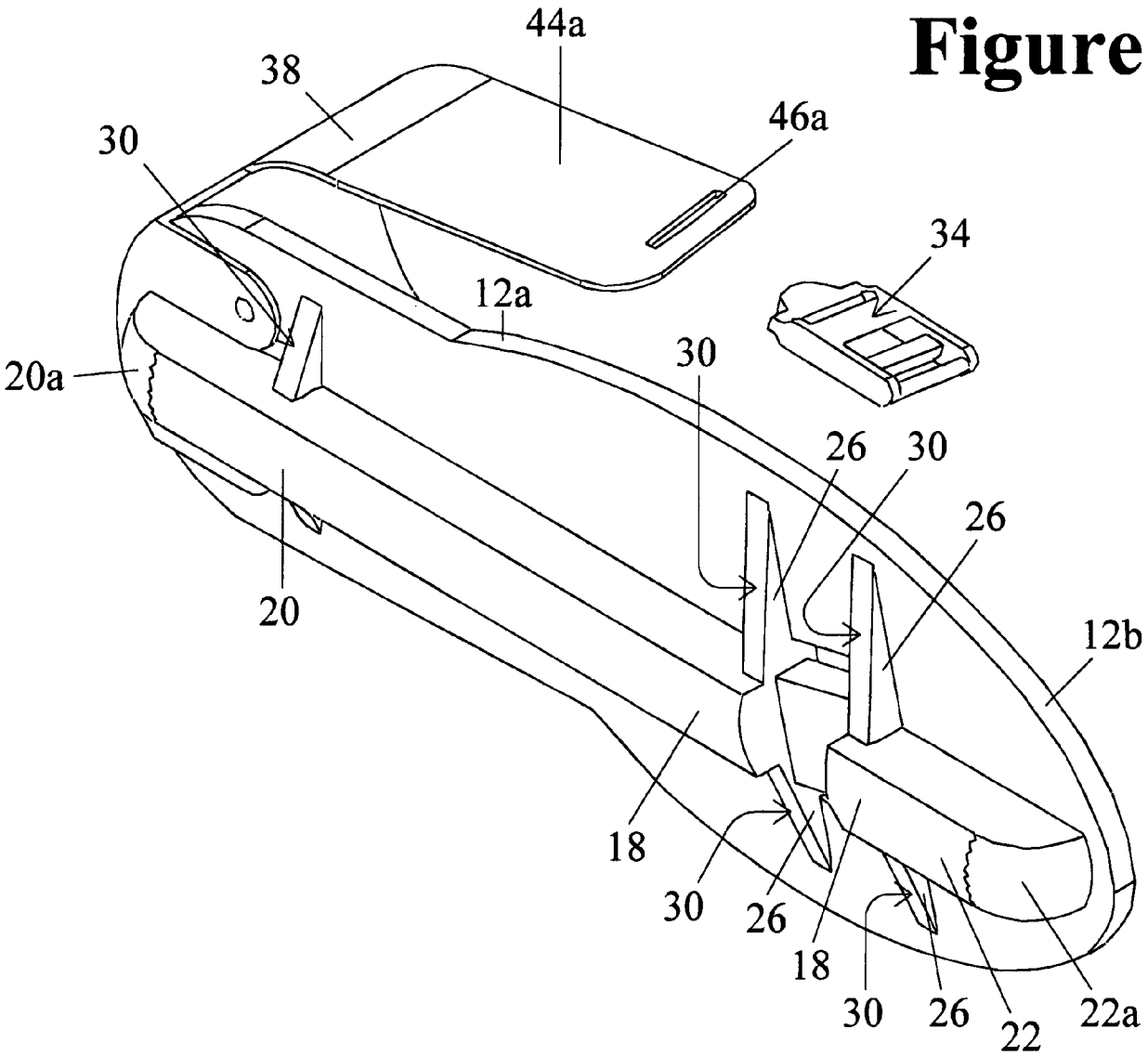
FIG. 8 is a bottom perspective view of another exemplary embodiment of the shoe accessory of FIGS. 1-5.

In the exemplary embodiments shown in FIGS. 1-5 and 8, the platform 12 includes not only ridge segments 20, 22, but also support members 26 extending laterally of the platform 12. Each support member 26 abuts both one of the ridge segments 20, 22, and the bottom side 28 of the platform 12. Each support member 26 is configured such that its lower edge 30 does not extend beyond a line having a first endpoint (W') at an outer edge of the platform 12, and a second endpoint (W) at a point of contact of the ridge segment 20, 22 with the ground, as best shown in FIGS. 3 and 4. In this manner, each support member 26 will not interfere with movements of the laterally unstable platform 12 on relatively flat ground, and lateral rocking motion of the platform 12 about a ridge segment 20, 22 will be constrained only by the structure of the platform 12 and base 16, and not by the support members 26. Further, the support members 26 provide an additional measure of lateral rigidity to the shoe accessory without compromising longitudinal flexibility. Consequently, lateral shifts in weight during use do not result in excessive lateral flexing of the shoe accessory 10. Rather, such shifts in weight result primarily in lateral rocking motion of the shoe accessory 10 about the ridge segments 20, 22, as generally shown in direction X of FIGS. 2 and 4. In a preferred embodiment, the support members 26 are positioned on opposite sides of the strap 32 to define a channel therebetween for passage and constraint of the strap 32, as best shown in FIGS. 1, 3 and 8.

Figure 6:
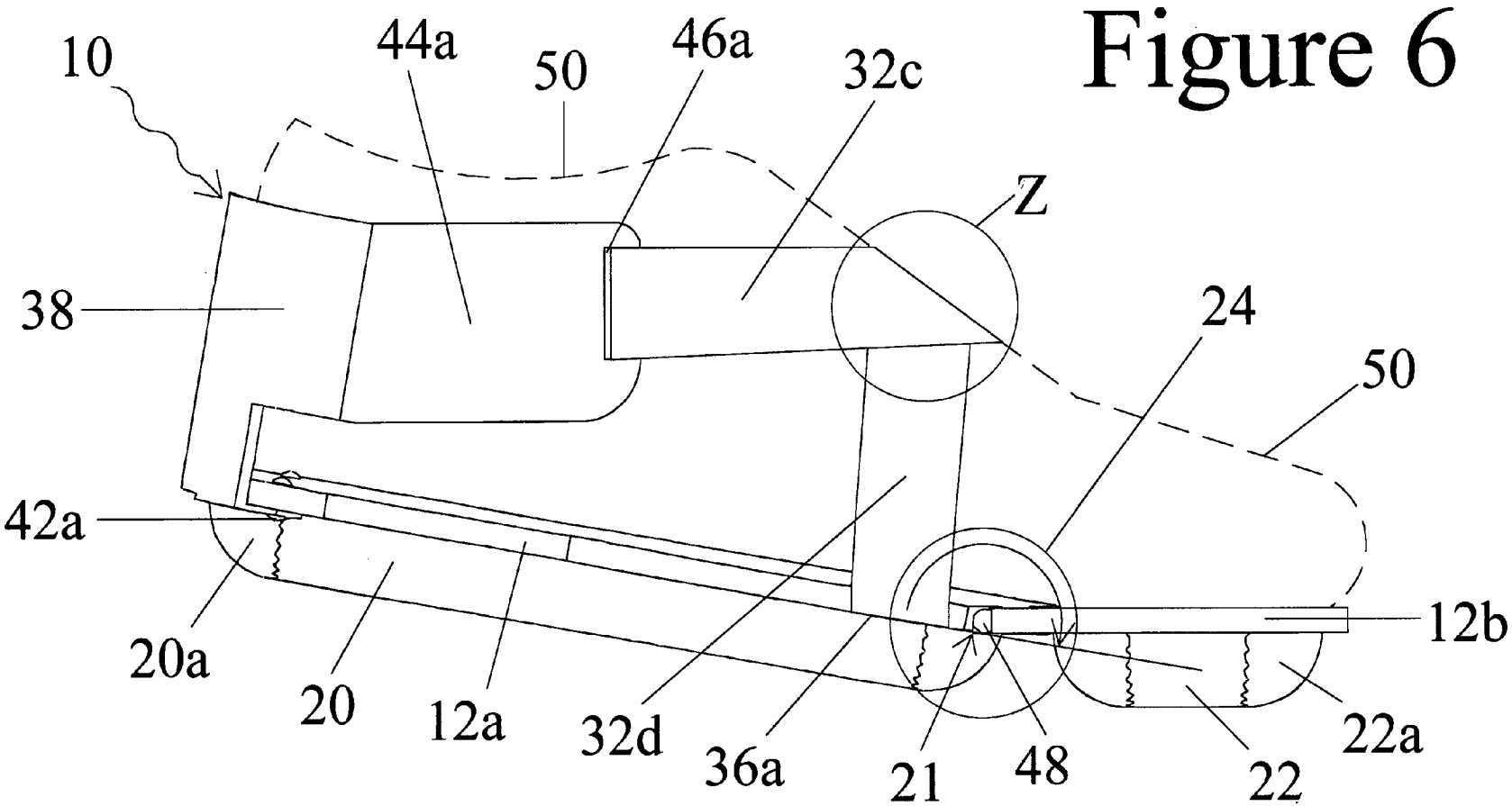
FIG. 6 is a side perspective view of an exemplary alternative embodiment of the shoe accessory of FIGS. 1-5.
Figure 7:
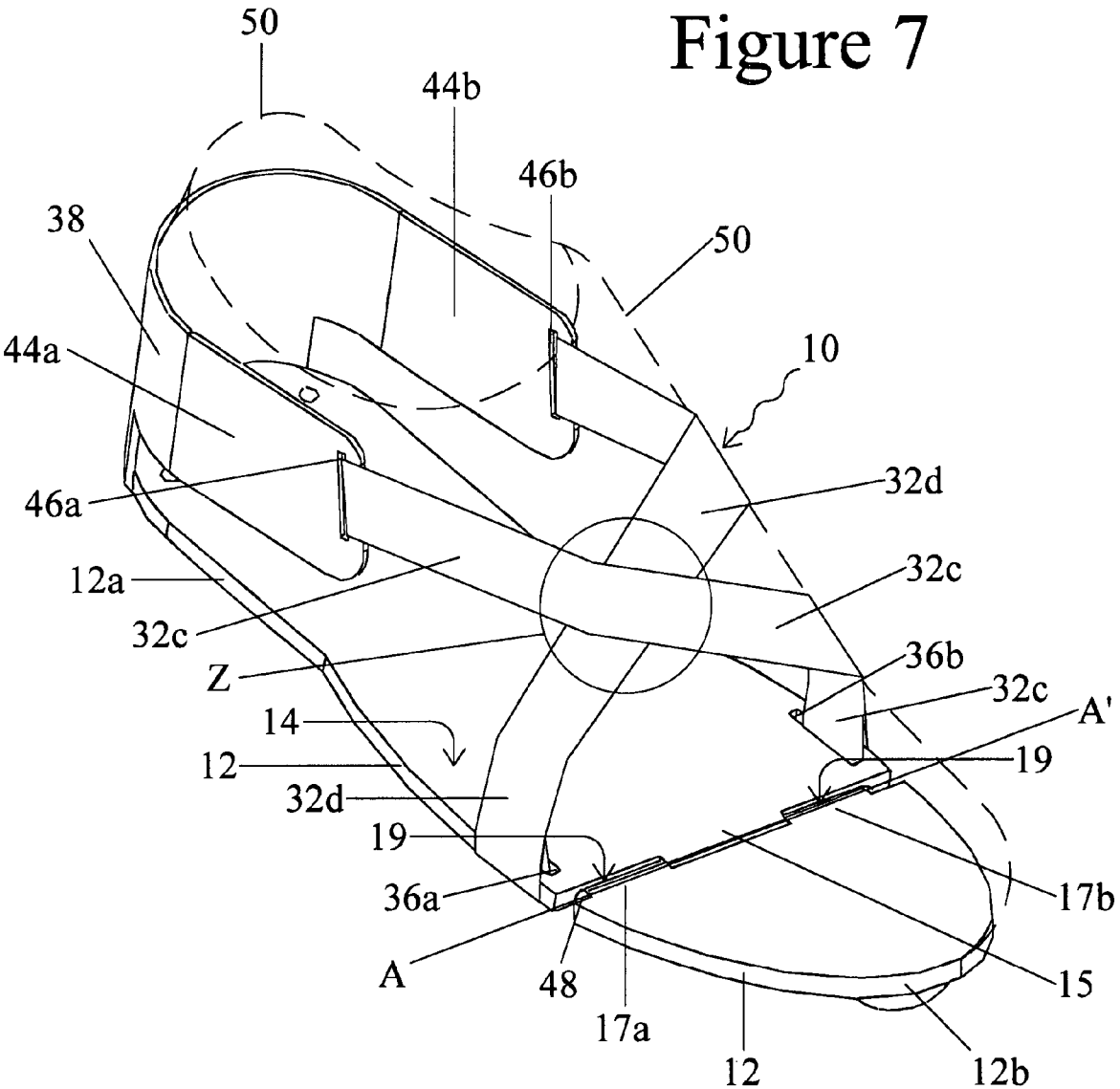
FIG. 7 is a front perspective view of the shoe accessory of FIG. 6.

The shoe accessory 10 is configured for temporary attachment to a conventional shoe 50, e.g. with the sole of the shoe resting on the upper surface 14 of the platform 12, in a non-destructive manner that will not damage the shoe 50. By way of example, the shoe accessory 10 may be provided with a strap 32 including one or more strap segments 32*a* and 32*b*. In one embodiment, the strap 32 is made of elastic webbing, and the ends of the strap are fixed to the structure of the shoe accessory as best shown in FIGS. 6 and 7. In an alternative embodiment, as shown in FIGS. 1-5, the strap's strap segments 32*a*, 32*b* are made of relatively inelastic webbing and an adjustable fastener is used to secure the straps around the shoe. An exemplary adjustable fastener is the ladder lock buckle 34 that is shown in FIGS. 1, 2, 3 and 8.

The platform 12 may be provided with a slot 36*a*, 36*b* on each side of its toe segment 12*b*, and the strap is threaded through the slots. In one embodiment, the slots extend through the platform's thickness, and the straps are threaded through the platform's thickness, and thus a segment of the strap lies atop the platform. The straps ends extend back from the start in a crossing pattern, as shown in FIGS. 1 and 2. The ends of the strap are attached to a heel retainer 38, as discussed further below. In one embodiment the strap is a unitary member and the elasticity of the strap allows for secure attachment to a variety of shoes of various sizes and configurations. In an alternative embodiment, the strap includes a first strap segment 32*a* that is fixed on one side of the heel retainer and terminates at the buckle 34, and a second strap segment 32*b* is fixed to the opposing side of the heel retainer, such that the strap segments 32*a*, 32*b* and buckle 34 are adjustably fastenable to accommodate feet/shoes of various sizes, as best shown in FIG. 2. In this embodiment, the strap segments may be relatively inelastic.

In a certain embodiment, as shown in FIG. 2, the platform includes a portion 40 that is recessed from the surrounding surface portion 14 of the platform 12. This recessed portion 40, and the corresponding position of the slots 36*a*, 36*b* allow the strap to follow a flat path along at least a substantial portion of the width of the platform 12, thereby reducing stress on the platform 12 in the vicinity of the slots 36*a*, 36*b*, as best shown in FIGS. 2 and 3. Further, the recessed portion 40 permits the strap(s) to lie beneath the plane of the upper surface 14 of the platform 12, thereby reducing wear on the strap caused by the wearer's shoe.

As best shown in FIGS. 1 and 2, the shoe accessory 10 may be provided with a heel retainer 38 for limiting longitudinal movement of the shoe 50 relative to the platform 12. For this purpose, the heel retainer 38 is positioned adjacent to the heel end of the platform 12 and has a rigid central section that is preferably generally U-shaped for abutting a rearmost portion of the heel of the shoe, e.g., to cup and brace the heel portion of the shoe 50. The heel retainer 38 is joined to the platform 12 (or heel segment thereof) adjacent to its back end and extends above the top surface of the platform 12, as shown in FIGS. 1 and 2. For example, the heel retainer 38 may be integrally formed with the platform, e.g. via injection molding the heel retainer 38 and the platform 12 as a unitary body. Alternatively the heel retainer 38 may be a discrete member mechanically, adhesively, or otherwise fastened to the platform 12. In the exemplary embodiments of FIGS. 1-5 and 6-7, the heel retainer 38 is mechanically joined to the platform 12 by rivets 42*a*, 42*b*. The heel retainer 38 is preferably substantially rigid to allow for secure fastening of the shoe accessory 10 to the shoe 50, and for supporting the shoe's heel.

The heel retainer 38 may also include flexible side portions 44*a*, 44*b* that are capable of bending around and laterally embracing the heel of the shoe 50, as best shown in FIGS. 1 and 2. In this manner, the flexible side portions 44*a*, 44*b* are resiliently adjustable, and thus further improve the shoe accessory's adaptability to a variety of shoes of various sizes and configurations. It should be noted that while these side portions are laterally flexible, they are vertically rigid, thereby further anchoring the accessory to the shoe. The side portions 44*a*, 44*b* may include slots 46*a*, 46*b*, as described below, to which the strap segments 32*a*, 32*b* are secured to allow for easy adjustment of the side portions 44*a*, 44*b* by adjustment of the strap(s) For example, the strap 32 or strap segments 32*a*, 32*b* may be secured to the side portions 44*a*, 44*b* by threading the ends of the strap/strap segments 32, 32*a*, 32*b* through a corresponding slot 46*a*, 46*b* and folding the respective end back and attaching it to a portion of the strap/strap members not threaded through the slots 46*a*, 46*b* via stitching, rivets, glue, etc. Alternatively the ends of the strap/strap members could be attached directly to the side portions 44*a*, 44*b* via stitching, rivets, glue, etc., in which case the slots 46*a*, 46*b* could be used to provide additional anchorage, by threading the ends through the slots and folding them back before attaching them directly to the extensions, or eliminated altogether.

The shoe accessory 10 is attachable, in a non-destructive manner, to a conventional, relatively flat-soled shoe 50 worn by a wearer. More particularly, the shoe 50 worn by the wearer may be inserted between the strap/strap segments 32, 32*a*, 32*b*, heel retainer 38 and platform 12, under the "X" formed by the strap/strap members, as shown at Z in FIGS. 1 and 2. Fixed elastic strap/strap members may be stretched to admit passage of the shoe 50, until the shoe 50 seats securely against the platform 12, at which time the strap/strap segments 32, 32*a*, 32*b* may be allowed to contract or be otherwise secured to secure the shoe accessory 10 to the shoe 50. Adjustable inelastic strap segments 32*a*, 32*b* may be secured with the buckle 34, etc. to secure the shoe accessory 10 to a shoe 50 in a corresponding manner. The adjustment of the strap segments 32*a*, 32*b* will cause the side portions 44*a*, 44*b* to securely engage and help retain the shoe 50, with the shoe's heel positioned in the heel retainer 38. Because of the elasticity or adjustability of the strap/strap segments 32, 32*a*, 32*b* and the flexibility of the side portions 44*a*, 44*b* on both sides of the heel retainer 38, the shoe accessory 10 can accommodate the shape and design of a variety of shoes.

After a shoe accessory 10 has been attached to each of the wearer's shoes 50, the wearer can move about, by walking, running, etc. As the wearer does so, the platform 12 flexes, in the vicinity of the ridge free span 24 and generally about line AA' of FIG. 2, in concert with the flexing of the wearer's foot and shoe during the transition from probation to suspiration.

The rearward ridge segment 20 and/or the forward ridge segment 22, depending on the phase of the stride, make the platform 12 and consequently the shoe accessory 10 and shoe 50 laterally unstable (i.e. permitting movement generally in the X direction as shown in FIGS. 2 and 4), thus providing a therapeutic effect. Consequently the wearer may walk, run, etc. in a conventional manner, causing the foot and/or ankle joint to move in a naturalistic manner while the wearer's shoes are made to be laterally unstable, even on a substantially flat surface. The wearer's muscles will attempt to stabilize the foot/shoe, thereby exercising, strengthening, and rehabilitating the wearer's ankle and surrounding foot/leg musculature during simple walking, running, etc. on a flat or substantially flat surface. This exercise tends to strengthen muscles that prevent inversion or eversion of the ankle that is characteristic of ankle sprains or other injuries. So it should be noted however, that the shoe accessory 10 and shoe 50 remain stable or relatively stable in a longitudinal (heel/toe) direction. It is believed that this is due, at least in part, to the surfaces of the ridge segments 20, 22 which are flat or relatively flat in the longitudinal (heel/toe) direction, and which are elongated to span a major portion (e.g. greater than 50%, or greater than 75%, of the length of the shoe accessory's platform).

FIGS. 6 and 7 show an alternative embodiment, in which the shoe accessory's platform 12 includes at least two discrete rigid segments 12*a*, 12*b* that are mechanically hinged in an appropriate location (see line AA' in FIG. 7) to enable the platform 12 to "flex" to accommodate the natural flexing of a foot during walking, running, etc. For example, a variety of plastic materials and metal materials have been found suitable for this purpose. More particularly, the heel segment 12*a* of the platform 12 includes a centrally located knuckle 15, and the toe segment 12*b* of the platform 12 has a pair of corresponding spaced knuckles 17*a*, 17*b*. The knuckles 15, 17*a*, 17*b* define openings there through and are alignable to form a hinge barrel such that a hinge pin 48 may be passed there through to mechanically couple the heel and toe platform segments 12*a*, 12*b* in a hinged manner. In a preferred embodiment, the top portions 19 of the knuckles 15, 17*a*, 17*b* are rounded to permit the segments 12*a*, 12*b* to rotate relative to one another to correspond to natural flexing of the foot, while the lower portions 21 of the knuckles 15, 17*a*, 17*b* are squared off to cause an interference between the knuckles and/or the platform 12 that prevents the hinged segments 12*a*, 12*b* from rotating relative to one another to form an angle that would not correspond to the natural flexing of a foot (see FIGS. 6 and 7). This configuration also prevents the toe segment 12*b* of the platform from falling down and away from the shoe 50 when the wearer's foot is lifted from engagement with the ground.

In the alternative embodiment of FIGS. 6 and 7, two separate fixed straps 32*c*, 32*d* are employed. The two straps 32*c*, 32*d* are arranged in a crossing pattern, as shown at Z in FIGS. 6 and 7, similar to that used in the embodiment shown in FIGS. 1 and 2, but rather than being threaded through slots 36*a*, 36*b* they are fixed to the slots, e.g. by threading the ends of straps 32*c* and 32*d* through slots 36*a* and 36*b*, respectively. The ends are then folded back and fixed to the portions of the strap not threaded through slots 36*a*, 36*b* via stitching, rivets, glue, etc. Alternatively, the ends of straps 32*c* and 32*d* could be attached, via stitching, rivets, glue, etc. directly to the heel 12*a* segment of the platform, the attachment points being in the vicinity of slots 36*a* and 36*b*, respectively. The opposite ends of the straps 32*c*, 32*d* are fixed to the side portions 44*a*, 44*b* of the heel retainer 38 as described above. The slots in the side portions 46*a*, 46*b* may be retained to provide additional anchorage, by threading the ends through the slots and folding them back before fixing them directly to the side portions, 44*a*, 44*b* of the heel retainer, or eliminated altogether.

The alternative embodiment of the shoe accessory 10 that is shown in FIGS. 6 and 7 is attached to the wearer's shoe 50 in a manner similar to that described above. As in the preferred embodiment, the platform 12 "flexes" in concert with the wearer's foot and shoe 50 by the pivoting of the platform's segments 12*a*, 12*b* about the hinge line AA'.

Optionally, a pair of shoe accessories 10 may be sold together, e.g. in a single package, to provide an exercise kit. In one such embodiment, the platforms 12 of the shoe accessories 10 are identical. In an alternative embodiment, one of the shoe accessories has a platform 12 contoured to support the sole of a left shoe (i.e. contoured similarly to the sole of a shoe designed to fit a person's left foot), and the other of the shoe accessories has a platform 12 contoured to support the sole of a right shoe.

Accordingly, the present invention provides a nondestructive means for making a flat soled shoe laterally unstable while allowing for longitudinally stability and a naturalistic gait.

Having thus described particular embodiments of the invention, various alterations, modifications, and improvements will readily occur to those skilled in the art. As non-limiting examples, more than one hinge could be employed to facilitate bending of the platform. Various methods of attachment are also possible. For instance, the shoe accessory could be attached to the wearer's shoe with two straps, one over the fore foot and one over the mid foot, with a heel retainer around the heel to prevent the accessory from sliding forward. Such alterations, modifications and improvements as are made obvious by this disclosure are intended to be part of this description though not expressly stated herein, and are intended to be within the spirit and scope of the invention. Accordingly, the foregoing description is by way of example only, and not limiting.

What is claimed is:

1. A shoe accessory configured for temporary mounting to a shoe, the shoe accessory comprising:

a platform having a top side for supporting a sole of the shoe, a bottom side opposite said top side, a toe portion and a heel portion, said platform being configured to bend in a region proximate a junction of said toe portion and said heel portion in a manner corresponding to bending of the shoe during walking movement;

a base disposed on said bottom side of said platform, said base including a non-planar surface that causes said platform to be stable, relative to a flat surface supporting said base, in a longitudinal direction of elongation from said toe portion to said heel portion, and to be unstable, relative to said flat surface, in a lateral direction transverse to said longitudinal direction, said non-planar surface extending from said bottom side of said platform and being closed and continuous;

a strap attached to said base, said strap being capable of securing said shoe accessory to the shoe; and a heel retainer joined to said platform proximate said heel portion of said platform, said heel retainer extending above said top surface of said platform, said heel retainer being shaped to receive a heel of the shoe, said heel retainer comprising a rigid central section for abutting a rearmost portion of said heel of the shoe, and a pair of opposed side portions extending from said heel portion toward said toe portion, said side portions being flexible relative to said central section, said side portions being capable of bending around and laterally embracing said heel of the shoe.

2. The shoe accessory of claim 1, wherein said strap is attached to at least one of said pair of opposed side portions.

3. The shoe accessory of claim 1, wherein said strap includes multiple discrete strap segments.

4. The shoe accessory of claim 3, further comprising a fastener joined to at least one of said strap segments and capable of selectively securing said strap segments to each other to secure the shoe to said platform.

5. The shoe accessory of claim 3, wherein said strap segments are positioned relative to said platform in a manner in which a portion of said strap segments overlap.

6. The shoe accessory of claim 1, wherein said platform comprises a plurality of discrete rigid segments, said platform being configured to bend by a mechanical hinge providing pivotal movement of said segments relative to one another.

7. The shoe accessory of claim 1, said mechanical hinge comprising at least one knuckle defined on each segment, each said knuckle comprising an internal opening, and a hinge pin pivotably joining said knuckles.

8. The shoe accessory of claim 1, wherein said platform comprises a unitary body constructed of a material capable of bending at said region.

9. The shoe accessory of claim 8, wherein said platform has a thickness at said region that is less than a second thickness adjacent said region.

10. The shoe accessory of claim 8, wherein said platform is constructed of a first material at said region, and a second material adjacent said region, said first material being different from said second material and being less resistant to bending relative thereto.

11. The shoe accessory of claim 1, wherein said non-planar surface is defined by an outer surface of a ridge.

12. The shoe accessory of claim 11, wherein said ridge comprises a plurality of discontinuous ridge segments, a first of said ridge segments being disposed on said bottom side of said heel portion, a second of said ridge segments being disposed on said bottom side of said toe portion, said first and second ridge segments defining a ridge free span therebetween, said ridge free span being disposed adjacent said region.

13. The shoe accessory of claim 11, wherein said ridge is uniform in cross-section along substantially all of its length.

14. The shoe accessory of claim 11, wherein said ridge is chevron shaped in cross-section.

15. The shoe accessory of claim 11, wherein said ridge is convex in cross-section.

16. The shoe accessory of claim 15, wherein said ridge is semi-circular in cross-section.

17. The shoe accessory of claim 16, where said ridge includes a forward end and a rearward end, each of said ends comprising a quarter-spherical structure.

18. The shoe accessory of claim 11, further comprising at least one support member extending laterally of said platform, said support member abutting both a portion of said ridge and said bottom side of said platform.

19. A shoe accessory configured for temporary mounting to a shoe, the shoe accessory comprising:

a platform having a top side for supporting a sole of the shoe, a bottom side opposite said top side, a toe portion and a heel portion, said platform being configured to bend in a region proximate a junction of said toe portion and said heel portion in a manner corresponding to bending of the shoe during walking movement;

a ridge disposed on said bottom side of said platform, said ridge including an outer surface that is substantially linear in a longitudinal direction of elongation from said toe portion to said heel portion, and that is convex in a lateral direction transverse to said longitudinal direction, said ridge comprising a plurality of discontinuous ridge segments, a first of said ridge segments being disposed on said bottom side of said heel portion, a second of said ridge segments being disposed on said bottom side of said toe portion;

a strap attached to said platform, said strap being capable of securing said shoe accessory to the shoe; and a heel retainer joined to said heel portion of said platform, said heel retainer extending above said top surface of said platform.

20. An exercise kit comprising:

a pair of shoe accessories, each shoe accessory comprising:

a platform having a top side for supporting a sole of the shoe, a bottom side opposite said top side, a toe portion and a heel portion, said platform being configured to bend in a region proximate a junction of said toe portion and said heel portion in a manner corresponding to bending of the shoe during walking movement;

a base disposed on said bottom side of said platform, said base including a non-planar surface defining a longitudinally extending, centrally-disposed ridge having a portion that is uniform in transverse cross-section and that causes said platform to be stable, relative to a flat surface supporting said base, in a longitudinal direction of elongation from said toe portion to said heel portion, and to be unstable, relative to said flat surface, in a lateral direction transverse to said longitudinal direction; and a strap attached to said base, said strap being capable of securing said shoe accessory to the shoe.

21. The kit of claim 20, wherein one of said pair of shoe accessories has a platform contoured to support the sole of a left shoe, and the other of said pair of shoe accessories has a platform contoured to support the sole of a right shoe.

22. A shoe accessory configured for temporary mounting to a shoe, the shoe accessory comprising:

a unitary platform having a top side for supporting a sole of the shoe, and a bottom side opposite said top side;

a protruding ridge disposed on said bottom side of said platform to provide a non-planar base of said shoe accessory, said ridge extending longitudinally of said platform, at least a portion of said ridge being uniform in cross-section in the longitudinal direction and having an outer surface that is convex in a lateral direction transverse to said longitudinal direction, said outer surface being substantially continuous from said bottom side of said platform to an apex of said convex portion;

a strap attached to said platform, said strap being capable of securing said shoe accessory to the shoe; and a heel retainer joined to said platform, said heel retainer extending above said top surface of said platform.

* * * * *